US008939091B2

(12) United States Patent
Suzuki

(10) Patent No.: US 8,939,091 B2
(45) Date of Patent: Jan. 27, 2015

(54) DISPLAY RACK

(75) Inventor: Akihito Suzuki, Chiba (JP)

(73) Assignee: Tanax, Inc., Kyoto-shi (JP)

( * ) Notice: Subject to any disclaimer, the term of this patent is extended or adjusted under 35 U.S.C. 154(b) by 0 days.

(21) Appl. No.: 13/698,193

(22) PCT Filed: May 12, 2011

(86) PCT No.: PCT/JP2011/060972

§ 371 (c)(1),
(2), (4) Date: Nov. 15, 2012

(87) PCT Pub. No.: WO2011/145510

PCT Pub. Date: Nov. 24, 2011

(65) Prior Publication Data

US 2013/0062298 A1 Mar. 14, 2013

(30) Foreign Application Priority Data

May 17, 2010 (JP) ..... 2010-113158

(51) Int. Cl.
*A47B 57/00* (2006.01)
*A47F 5/10* (2006.01)
(Continued)

(52) U.S. Cl.
CPC ..... *A47F 5/0018* (2013.01); *A47F 5/10* (2013.01)
USPC ..... 108/96; 108/106; 211/128.1; 211/135

(58) Field of Classification Search
CPC ..... A47F 5/10; A47F 7/00
USPC ..... 211/73, 126.14, 126.16, 128.1, 130.1, 211/135, 72, 186, 144, 188, 149, 150, 195, 211/189, 175; 220/23.83, 23.86, 23.4, 23.8, 220/8; 206/736, 740, 743, 745; 108/92–93, 108/96, 99, 102, 106
See application file for complete search history.

(56) References Cited

U.S. PATENT DOCUMENTS 303,783 A * 8/1884 Zimmerman ..... 312/271
744,855 A * 11/1903 Becker ..... 206/743
(Continued)

FOREIGN PATENT DOCUMENTS

JP A-9-140521 6/1997
JP H11-275967 10/1999
(Continued)

OTHER PUBLICATIONS

Dec. 10, 2012 International Preliminary Report on Patentability issued in International Patent Application No. PCT/JP2011/060972 (with translation).
(Continued)

*Primary Examiner* — Jonathan Liu
*Assistant Examiner* — Devin Barnett
(74) *Attorney, Agent, or Firm* — Oliff PLC

(57) ABSTRACT

A display rack capable of being transformed between a first configuration, in which a plurality of rack boxes are arranged in tiers and a second configuration, in which the plurality of rack boxes are vertically arranged in line, the display rack comprising an upper rack having an upper rack box and an upper back plate for holding the upper rack box, a lower rack having a lower rack box and a lower back plate for holding the lower rack box, and a connection member for connecting the upper rack and the lower rack the connection member being rotatably supported at a horizontal line lower than the upper rack box on a front side of the upper back plate and a horizontal line higher than the lower box on a back side of the lower back plate.

1 Claim, 4 Drawing Sheets

(51) Int. Cl.

| | |
|---|---|
| *A47B 9/00* | (2006.01) |
| *A47F 3/14* | (2006.01) |
| *A47F 5/00* | (2006.01) |

(56) References Cited

U.S. PATENT DOCUMENTS

| | | | | | |
|---|---|---|---|---|---|
| 939,807 | A | * | 11/1909 | Collins | 206/743 |
| 1,541,211 | A | * | 6/1925 | Ford | 220/23.83 |
| 1,731,878 | A | * | 10/1929 | Tanner | 206/743 |
| 1,758,726 | A | * | 5/1930 | Webb | 108/99 |
| 1,770,618 | A | * | 7/1930 | Lambert | 206/750 |
| 1,929,615 | A | * | 10/1933 | Tanner | 206/743 |
| 1,955,769 | A | * | 4/1934 | Reynolds | 211/130.1 |
| D153,828 | S | * | 5/1949 | Settle | D3/284 |
| 2,772,003 | A | * | 11/1956 | Volz | 211/130.1 |
| 4,716,841 | A | * | 1/1988 | Suttles | 108/108 |
| 5,706,959 | A | * | 1/1998 | Smith | 248/174 |
| 5,746,139 | A | * | 5/1998 | Villanueva | 108/92 |
| RE36,638 | E | * | 4/2000 | Herman | 211/149 |
| 6,053,114 | A | * | 4/2000 | Villanueva | 108/96 |
| 6,135,032 | A | * | 10/2000 | Ko | 108/96 |
| 6,321,663 | B1 | * | 11/2001 | Rogers | 108/100 |
| 6,543,796 | B1 | * | 4/2003 | Johnson et al. | 280/47.18 |
| 6,571,969 | B2 | * | 6/2003 | Larbaletier | 211/150 |
| 7,111,743 | B1 | * | 9/2006 | Moss et al. | 211/72 |
| 7,537,121 | B2 | * | 5/2009 | Markson et al. | 206/745 |
| 2002/0023889 | A1 | * | 2/2002 | Larbaletier | 211/150 |
| 2004/0074855 | A1 | * | 4/2004 | Wons et al. | 211/55 |
| 2005/0077695 | A1 | * | 4/2005 | Sherer et al. | 280/79.5 |
| 2006/0070911 | A1 | * | 4/2006 | Lowry | 206/736 |
| 2006/0124565 | A1 | * | 6/2006 | Speed et al. | 211/72 |
| 2006/0249059 | A1 | * | 11/2006 | Gagne | 108/59 |
| 2007/0187289 | A1 | * | 8/2007 | Markson et al. | 206/743 |
| 2008/0169254 | A1 | * | 7/2008 | Govrik | 211/103 |
| 2008/0272566 | A1 | * | 11/2008 | Thompson | 280/79.5 |
| 2010/0108623 | A1 | * | 5/2010 | Virvo | 211/49.1 |
| 2010/0117499 | A1 | * | 5/2010 | Fortier | 312/306 |

FOREIGN PATENT DOCUMENTS

| | | |
|---|---|---|
| JP | A-2003-61796 | 3/2003 |
| JP | U-3113539 | 9/2005 |
| JP | A-2006-247278 | 9/2006 |

OTHER PUBLICATIONS

Jun. 14, 2011 International Search Report issued in International Patent Application No. PCT/JP2011/060972.

Dec. 18, 2013 Office Action issued in Korean Application No. 10-2012-7032902 (with translation).

Jun. 17, 2014 Office Action issued in Chinese Patent Application No. 201180024537.6 (with English Translation).

Feb. 18, 2014 Notification of Reason for Rejection issued in Japanese Patent Application No. 2012-266859 (with English-language translation).

* cited by examiner

DISPLAY RACK

TECHNICAL FIELD

The present invention relates to a display rack having multiple rack boxes. In particular, it relates to a display rack capable of changing the arrangement of the rack boxes.

BACKGROUND ART

In conventional display racks for displaying goods or other items, rack boxes are arranged vertically or in tiers. In the case of a display rack to be used in a hung configuration, the rack boxes are usually arranged vertically; whereas in the case of a display rack to be used on a floor or in another position, the rack boxes are usually arranged in tiers for the sake of stability.

In stores displaying a variety of goods, either a rack with vertically arranged rack boxes or a rack with rack boxes arranged in tiers is selected and used depending on the available space in the store. Therefore, in order to change the display of the goods in accordance with the situation in the store, it is necessary to have both kinds of racks in each store, which is inconvenient.

In light of this, in the "jointed display shelf used as standing and suspended shelf in common" described in Patent Document 1, a single rack can be changed into both the configuration in which the rack boxes are vertically arranged and the configuration in which they are arranged in tiers. This eliminates the need for each store to separately prepare the two different kinds of racks. The jointed display shelf has connection plates and a support plate. The connection plates connect the side frames of the rack boxes. The support plate is sectioned by parallel longitudinal lines into a center area and two side areas. By inclining the connection plates, the rack boxes are arranged in tiers. When the rack boxes are arranged in tiers, the two side areas are folded vertically from the center area making the support plate function as a support for the tiered rack boxes.

BACKGROUND ART DOCUMENT

Patent Documents

[Patent Document 1] JP-A H9-140521

DISCLOSURE OF THE INVENTION

Problem to be Solved by the Invention

In the aforementioned structure, in order to change the rack from the configuration where the rack boxes are vertically arranged to the configuration where they are arranged in tiers, it is necessary to fold the support plate and interlock the latching slits provided in both the support plate and a back plate. This is troublesome.

The present invention has been achieved in view of the aforementioned problem, and the objective thereof is to provide a single rack which can be easily changed to either of the two aforementioned configurations.

Means for Solving the Problem

To solve the aforementioned problem, the first aspect of the present invention provides a display rack capable of being transformed between a first configuration, in which a plurality of rack boxes are arranged in tiers, and a second configuration, in which the plurality of rack boxes are vertically arranged in line, the display rack including:

an upper rack having an upper rack box and an upper back plate for holding the upper rack box;

a lower rack having a lower rack box and a lower back plate for holding the lower rack box; and a connection member for connecting the upper rack and the lower rack at a portion lower than the upper rack box and a portion higher than the lower rack box, wherein:

the connection member is rotatable about attachment lines to the upper rack and to the lower rack; and the connection member is rotated so as to be perpendicular or parallel to the upper back plate and the lower back plate, thereby transforming the display rack into the first configuration or into the second configuration.

To solve the aforementioned problem, the second aspect of the present invention provides a display rack as one mode of the display rack according to the first aspect of the display rack, wherein:

the upper back plate has a pair of upper columns on both sides thereof;

the lower back plate has a pair of lower columns on both sides thereof;

each of the upper columns is extendable and retractable at a lower part thereof; and each of the lower columns has a hole into which an extended portion of the upper column can enter from above when the display rack is transformed into the second configuration.

To solve the aforementioned problem, the third aspect of the present invention provides a display rack as one mode of the display rack according to the second aspect of the display rack, wherein:

each of the upper columns is composed of an outer case and a slide core contained inside the outer case;

an opening is provided on one side of the outer case;

a finger hole is provided on one side of the slide core; and the upper column can be extended and retracted by moving the finger hole within the opening.

Effects of the Invention

In the rack according to the present invention, by rotating the connection member so as to make it perpendicular to the upper back plate and the lower back plate, the upper back plate and the lower back plate stand apart from each other in the back and in the front, and the upper rack box of the upper rack and the lower rack box of the lower rack are arranged in tiers (the first configuration). By rotating the connection member so as to make it parallel to the upper back plate and the lower back plate, the upper back plate and the lower back plate are vertically aligned, and the rack box of the upper rack and that of the lower rack are vertically arranged (the second configuration). In this manner, the rack according to the present invention can be easily transformed into both the configuration in which the rack boxes are vertically arranged and the configuration in which they are arranged in tiers simply by vertically rotating the connecting member.

In the case where each of the upper columns is extendable and retractable at a lower part thereof, when the rack is in the second configuration, the lower end of the upper column can be extended to the point where it reaches the same level as the lower end of the lower column. By inserting the extended portion into the hole of the lower column, the upper rack box can be held more stably. In the rack according to the third aspect, it is only necessary for a user to insert his or her finger into the finger hole provided in the upper column and vertically slide the upper column to easily extend or retract the upper column.

BRIEF DESCRIPTION OF THE DRAWINGS

FIG. 1A shows the configuration in which rack boxes are vertically arranged, FIG. 1B shows the configuration in which a connection plate is being rotated from the configuration shown in FIG. 1A, and FIG. 1C shows the configuration in which the rack boxes are arranged in tiers.

BEST MODES FOR CARRYING OUT THE INVENTION

Embodiments of the present invention will be described with reference to FIGS. 1-6.

Embodiments

Figure 1A:
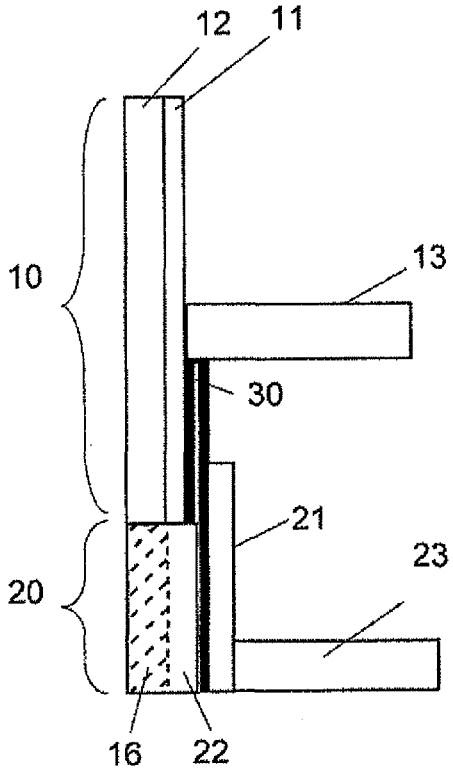
FIGS. 1A through 1C are explanatory diagrams for explaining the configuration change of the rack according to the present embodiment.
Figure 1B:
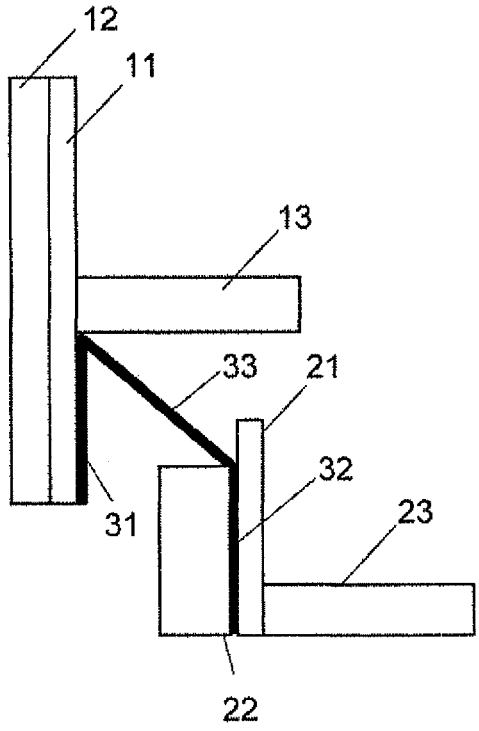
Figure 1C:
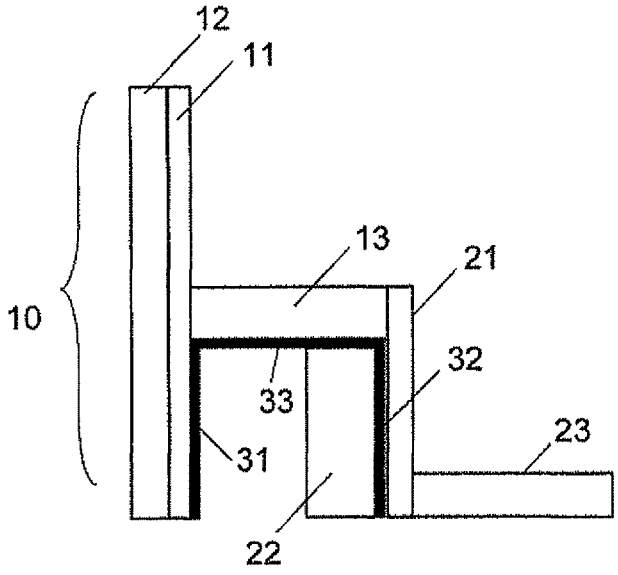
Figure 2:
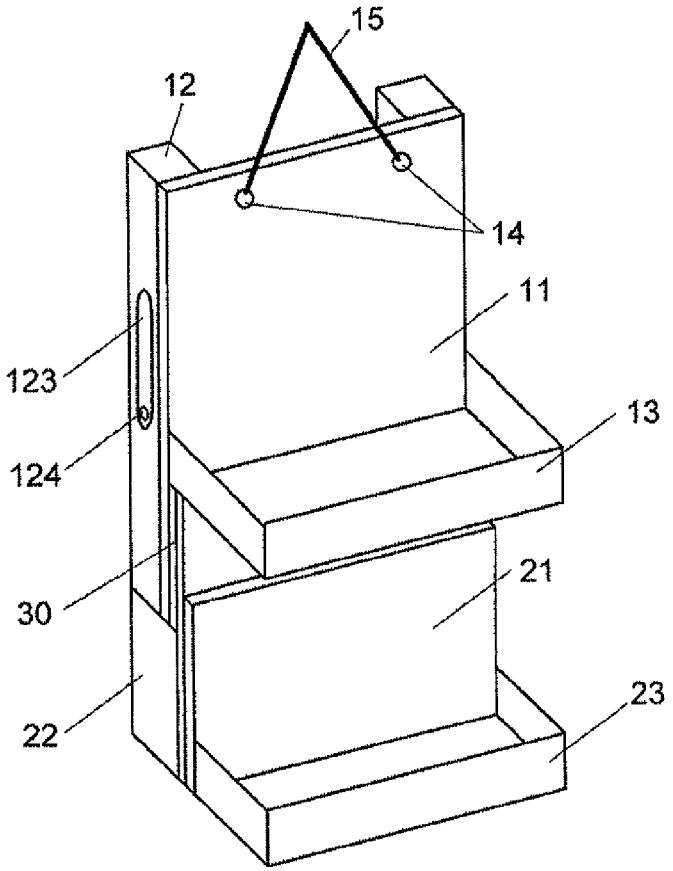
FIG. 2 is a perspective view of the rack according to the present embodiment, in which the rack boxes are arranged vertically.
Figure 3:
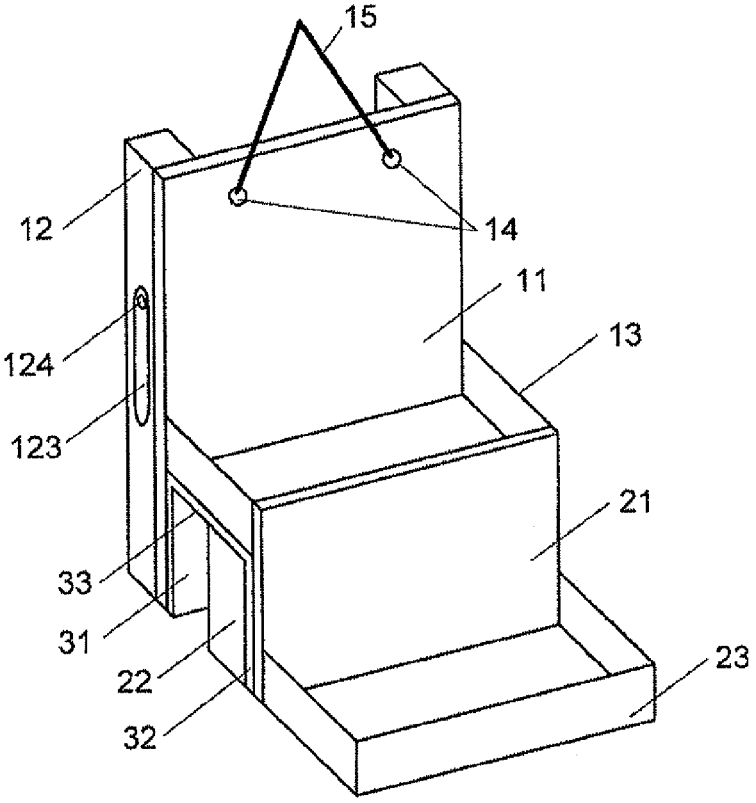
FIG. 3 is a perspective view of the rack according to the present embodiment, in which the rack boxes are arranged in tiers.

FIGS. 1A-1C are explanatory diagrams showing the change of the display rack according to the present embodiment from the configuration in which the rack boxes are arranged vertically (FIG. 1A) to the configuration in which they are arranged in tiers (FIG. 1C). FIG. 2 is a perspective view showing the configuration in which the rack boxes are arranged vertically, and FIG. 3 is a perspective view showing the configuration in which they are arranged in tiers. An upper rack 10 is composed of an upper back plate 11, upper columns 12 provided at the rear of the back plate 11 on both sides, and an upper rack box 13. The upper rack box 13 is horizontally attached to the front of the upper back plate 11. The upper rack box 13 is attached so that the lower end thereof is positioned above the lower end of the upper column 12 by the height of the lower column 22. Two cord holes 14 to pass a cord therethrough are provided in an upper part of the upper back plate 11. A cord 15 is passed through the cord holes 14. A lower rack 20 is composed of a lower back plate 21, lower columns 22 provided at the rear of the lower back plate 21 on both sides, and a lower rack box 23. The lower rack box 23 is anteriorly attached at the lower end of the lower back plate 21. The lower columns 22 are hollow.

A connection plate 30 is composed of an upper back plate bonded section 31, a lower back plate bonded section 32, and a connection section 33. Both the boundary between the upper back plate bonded section 31 and the connection section, 33 (first horizontal boundary line), and the boundary between the lower back plate bonded section 32 and the connection section 33 ( second horizontal boundary line) are linearly formed. The connection plate 30 can be folded at each boundary line. The upper back plate bonded section 31 is bonded below an attachment section of the upper rack box 13 in front of the upper back plate 11. The lower back plate bonded section 32 is bonded to the back surface of the lower back plate. The boundary line between the connection section 33 and the upper back plate bonded section 31 is horizontally placed along the lower end of the area to which the upper rack box 13 is attached. The length of the connection section 33 is the same as the depth of the bottom surface of the upper rack box 13. The upper back plate 11, the upper columns 12, the upper rack box 13, the lower back plate 21, the lower columns 22, the lower rack box 23, and the connection plate 30 in the present embodiment are all made of cardboard.

First, the configuration in which the rack boxes are vertically arranged will be described with reference to FIGS. 1A and 2. The connection plate 30 is not folded at the boundary line between the connection section 33 and the lower back plate bonded section 32, but it is folded 180 degrees at the boundary line between the connection section 33 and the upper back plate bonded section 31. Consequently, the upper back plate 11 and the lower back plate 21 are vertically aligned via the connection plate 30. Since the upper columns 12 are positioned above the lower columns 22, by extending the upper columns 12 downward so that the extended portion 16 (the hatched portion in FIG. 1A) are contained inside the lower columns 22, the upper rack 10 can be stably connected to the lower rack 20. Accordingly, the entire rack can be hung using the cord 15 passed through the cord holes 14.

The rack can also be stably placed on a level surface, such as a floor, even in the configuration in which the rack boxes are vertically arranged, because the lower rack 20 is supported by the lower columns 22 and the bottom surface of the lower rack box 23.

Next, the procedure for changing the rack from the configuration in which the rack boxes are arranged vertically (FIG. 1A) to the configuration in which they are arranged in tiers (FIG. 1C) will be described (also with reference to FIG. 1B). The folding angle at the boundary line between the connection section 33 and the upper back plate bonded section 31 in the connection plate 30 is reduced from 180 degrees. Before this process, the extended portion 16 of each upper column 12 should be retracted beforehand. At the same time, the connection plate 30 is folded at the boundary line between the connection section 33 and the lower back plate bonded section 32 so that the lower rack 20 projects anteriorly to the upper rack 10.

When the folding angle is 90 degrees at both the boundary line between the connection section 33 and the upper back plate bonded section 31 and the boundary line between the connection section 33 and the lower back plate bonded section 32, the connection section 33 is perpendicular to both the upper back plate 11 and the lower back plate 21 (see FIGS. 1C and 3). As previously described, since the boundary line between the connection section 33 and the upper back plate bonded section 31 is positioned above the lower end of the upper columns 12 by the height of the lower columns 22, the lower end of the lower columns 22 is level with the lower end of the upper columns 12. Therefore, by placing the lower columns 22 on a level surface such as a floor, the lower ends of the upper columns 12 are stably placed on the same level. This allows the rack in the tier configuration to be stably placed on a level surface. In addition, in the present embodiment, the boundary line between the connection section 33 and the upper back plate bonded section 31 is placed along the lower end of the area where the upper rack box 13 is attached. Accordingly, when the folding angle at the boundary line between the connection section 33 and the upper back plate bonded section 31 is 90 degrees, the bottom surface of the upper rack box 13 is placed on the connection section 33.

Figure 4A:
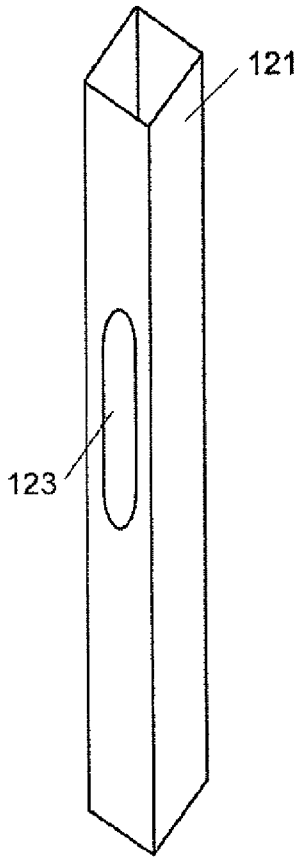
FIGS. 4A and 4B are perspective views of an outer case and a slide core, respectively, which compose the upper column according to the present embodiment.
Figure 4B:
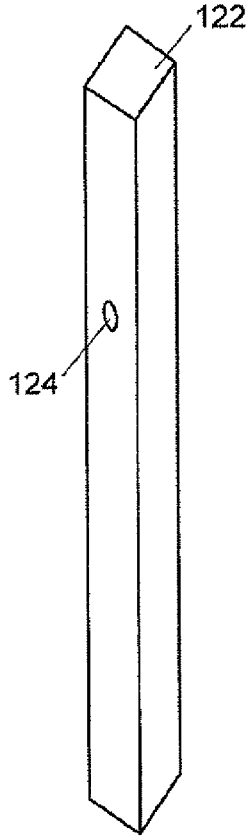
Figure 5:
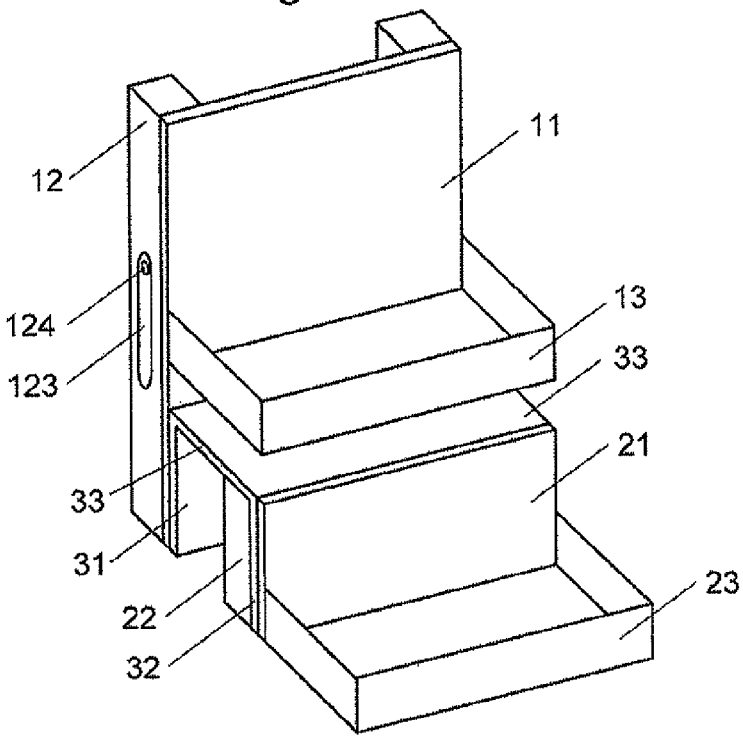
FIG. 5 is a perspective view of the rack according to a modification example of the present invention.
Figure 6:
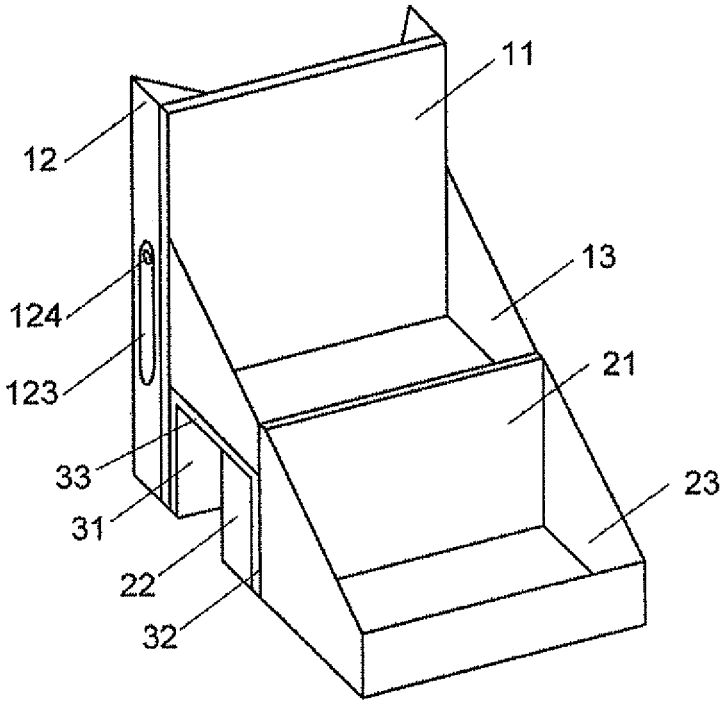
FIG. 6 is a perspective view of the rack according to a modification example of the present invention.

Next, the mechanism to extend the upper column 12 in the rack according to the present embodiment will now be described with reference to FIGS. 4A and 4B. The upper column 12 is composed of an outer case 121 and a slide core 122. The outer case is hollow and has an elongated opening 123 on a lateral side thereof. The external dimension of the slide core 122 is slightly smaller than the internal dimension of the outer case 121. A hole 124 into which a finger can be inserted is provided in an upper portion of a lateral side of the slide core 122. The slide core 122 is contained inside the outer case 121 so that the opening 123 and the hole 124 face the same direction. When the rack boxes are arranged in tiers, the slide core 122 is completely contained inside the outer case 121. In order to transform the display rack into the configuration in which the rack boxes are vertically arranged, a user inserts one of his/her fingers into the hole 124 through the opening 123 and slides the hole 124 downward along the opening. This exposes the slide core 122 from the lower end of the outer case 121 downwards, thereby elongating the upper column 12. The slide core 122 exposed from the lower end of the outer case 121 in this manner is contained inside the lower column 22, so that the upper column 12 and the lower column 22 are connected.

The present invention is not limited to the aforementioned embodiment, and modifications made within the spirit of the present invention are allowed. For example, the display rack in the present embodiment has two racks: the upper one and the lower one. However, the number of racks may be three or more. When the display rack has three racks, the intermediate rack is regarded as a lower rack in relation to the top rack, and it is regarded as an upper rack in relation to the bottom rack.

In the present embodiment, the connection plate 30 is composed of the upper back plate bonded section 31, the lower back plate bonded section 32, and the connection section 33. However, the connection plate 30 may be composed of the connection section 33 alone. In this case, the connection section 33 may be rotatably connected to the upper back plate 11 and/or the lower back plate 21 using a hinge or the like.

For example, in the present embodiment, the upper rack box 13 is attached to the upper rack 10 at a position along the boundary line between the connection section 33 and the upper back plate bonded section 31. However, the upper rack box 13 may be attached above the boundary line between the connection section 33 and the upper back plate bonded section 31 (see FIG. 5). In this case, when the rack boxes are arranged in tiers, the upper rack box 13 is not placed on the connection section 33 of the connection plate 30, but is positioned slightly above the connection section 33. In addition, the lower back plate bonded section 32 may double as the lower back plate 21, and the lower rack box 23 can be directly attached to the lower back plate bonded section 32. Further, the shape of the rack boxes is not necessarily a rectangular parallelepiped. The shape of the side panel of the rack box may be a trapezoid (see FIG. 6). The upper column 12 and the lower column 22 may have any possible shape, such as a triangular prism or cylindrical column (see FIG. 6), although their shape is a rectangular parallelepiped in FIGS. 2 and 3. The rack according to the aforementioned embodiment is made of cardboard. However, the material is not limited to paper; for example, plastic or other materials can be used.

EXPLANATION OF NUMERALS

Upper Rack
11 . . . Upper Back Plate
12 . . . Upper Column
13 . . . Upper Rack Box
14 . . . Cord Hole
15 . . . Cord
16 . . . Extended Portion of the Column
20 . . . Lower Rack
21 . . . Lower Back Plate
22 . . . Lower Column
23 . . . Lower Rack Box
30 . . . Connection Plate
31 . . . Upper Back Plate Bonded Section
32 . . . Lower Back Plate Bonded Section
33 . . . Connection Section
121 . . . Outer Case
122 . . . Slide Core
123 . . . Opening
124 . . . Hole

The invention claimed is:

1. A display rack capable of being transformed between a first configuration, in which a plurality of rack boxes are arranged in tiers and a second configuration, in which the plurality of rack boxes are vertically arranged in line, the display rack comprising:

an upper rack having an upper rack box and an upper back plate for holding the upper rack box;

a lower rack having a lower rack box and a lower back plate for holding the lower rack box;

a connection member for connecting the upper rack and the lower rack the connection member being rotatably at a horizontal boundary line lower than the upper rack box on a front side of the upper back plate and rotatable at a second horizontal boundary line higher than the lower rack box on a back side of the lower back plate, wherein the display rack can be transformed onto the first configuration or into the second configuration by rotating the connection member.

a pair of upper columns located on both sides; of the upper back plate, each of the upper columns including an outer case and a slide core contained inside the outer case, the slide core being extendable so as to be position lower than a lower end of the upper back plate and retractable so that the slide core is contained completely within the outer case; and a pair of lower columns located on both sides of the lower back plate, each of the lower columns having a hole into which the slide core of the respective upper column is inserted from above when the display rack is transformed into the second configuration, wherein:

an elongated opening is provided on one side of the outer case, a hole is provided on one side of the slide core, wherein a user can insert a finger into the hole via the opening and vertically adjust a height of the slide core; and when the rack is in the second configuration, each slide core can be extended to a point where a lower end of each slide core is at the same level as a lower end of each lower column.

* * * * *